United States Patent [19]

Nielsen

[11] 4,353,687

[45] Oct. 12, 1982

[54] ROTARY KILN

[75] Inventor: Poul W. Nielsen, Copenhagen, Denmark

[73] Assignee: F. L. Smidth & Co., Cresskill, N.J.

[21] Appl. No.: 221,517

[22] Filed: Dec. 30, 1980

[30] Foreign Application Priority Data

Jan. 2, 1980 [GB] United Kingdom ..... 8000095

[51] Int. Cl.[3] ..... F27D 15/02; F27B 7/00

[52] U.S. Cl. ..... 432/80; 432/103

[58] Field of Search ..... 432/80, 103

[56] References Cited

U.S. PATENT DOCUMENTS 4,193,759 3/1980 Wurr et al. .

FOREIGN PATENT DOCUMENTS 2734230 2/1979 Fed. Rep. of Germany ..... 432/80

2702876 2/1980 Fed. Rep. of Germany .

*Primary Examiner*—John J. Camby

*Attorney, Agent, or Firm*—Pennie & Edmonds

[57] ABSTRACT

A rotary kiln having a plurality of outlets for passage of material from within the kiln to associated cooler tubes mounted in use in planetary fashion around the outlet end of the kiln. Each kiln outlet has a tubular support to which the inlet end of the associated cooler tube is attached, and a steel reinforcing ring within the support. Insulation is provided between the ring and the support and the ring is lined internally with a wear-resisting ceramic material. An annular collar is formed of the same material as the ring and extends radially beyond the joint between the support and the kiln shell. The collar—which is bolted to the kiln shell—is insulated from both the support and the kiln shell and is coated with a wear-resistant ceramic material.

10 Claims, 3 Drawing Figures

ROTARY KILN

TECHNICAL FIELD

This invention relates to kilns and, in particular, to rotary kilns having a plurality of outlets for passing material from within the kiln to associated cooler tubes mounted in planetary fashion around the outlet end of the kiln.

BACKGROUND ART

In kilns of the type contemplated by the present invention each kiln outlet has a tubular support to which the inlet end of the associated cooler tube is attached and a steel reinforcing ring within the support. Insulation is provided between the ring and the support and the ring is lined internally with a wear-resisting ceramic material.

In a typical rotary kiln having a plurality of such outlets, it is well known to reinforce the outlets with a reinforcing frame in the form of a ring or a bush of special steel, in such a way that its axially inner end relative to the kiln is substantially flush with the kiln lining. Since the action of the hot clinker within the kiln when in use is detrimental to the ring, it is normally lined internally with a heat-resistant, wear-resistant material which is cast on the inside of the ring and secured to the ring by suitable bracing elements. The axially inner edge of the ring can also be recessed relative to the kiln lining and coated with a ceramic material flush with the kiln lining.

Inasmuch as the steel ring and the kiln lining material expand at different rates as a result of the inevitable heat stresses, cracks can form between the ring and kiln lining. These cracks may expose the support to detrimental heat stresses from the hot clinker material. In an attempt to avoid such crack formations, according to German published application No. DTOS No. 27 02 876, the steel ring is provided with a braced, cast-on coat or collar of ceramic material. However, the steel ring is secured in place at its end within the support and thus longitudinal expansion of the ring caused by heating will cause the cast-on collar to be raised from its position of abutment against the kiln shell so that it can be easily knocked loose when it is hit by discharged clinker. Furthermore, hot clinker dust may also penetrate under the collar which therefore fails to fulfill its protecting effect at the critical joint between the kiln shell and the support.

DISCLOSURE OF THE INVENTION

A rotary kiln which comprises a plurality of outlet openings for passing material from within the kiln to associated cooler tubes mounted in planetary fashion around the outlet end portion of the kiln, each kiln outlet opening having a tubular support member to which the inlet end portion of the associated cooler tube is attached, and a reinforcing ring positioned within the support members. Insulation means is positioned between the ring and the support member, the ring being lined internally with a wear-resisting ceramic material. An annular collar formed of the same material as the ring is carried by the ring at the end portion thereof closest to the kiln, the collar extending radially beyond the joint between the support member and the kiln shell, the collar being insulated from both the support member and the kiln shell. Means is provided for attaching the collar to the kiln shell, and coating means in the form of wear-resistant ceramic material is provided on the collar.

This it will be appreciated that in order to overcome the problems of the prior art and in accordance with the present invention a kiln of the kind described is provided in which the steel reinforcing ring carries, at its end located within the kiln, an annular collar formed of the same material as the ring, the collar extending radially beyond the joint between the support and the kiln shell, being insulated from both the support and the kiln shell being bolted to the kiln shell, and being coated with a wear-resistant ceramic material.

The ceramic material with which the collar is coated may be flush with the kiln lining and with the lining of the reinforcing ring, and may be formed integrally with the lining of the reinforcing ring.

Preferably, the annular collar is formed integrally with the ring.

The ceramic material coating the ring is normally chosen for its wear-resistant capability and therefore its heat conductivity may be considerable. In order to avoid undesirable strong heating of the steel reinforcing ring a layer of insulating material may be provided between the ring and its internal coating of ceramic material.

To avoid uncontrolled crack formation in the ceramic material when the material and the ring with its collar expand differentially due to heating, radially orientated expansion joints may be provided in the ceramic material.

BRIEF DESCRIPTION OF THE DRAWINGS

The present invention will be described in detail hereinbelow with reference to the accompanying drawings wherein.

BEST MODE FOR CARRYING OUT THE INVENTION

Figure 1:
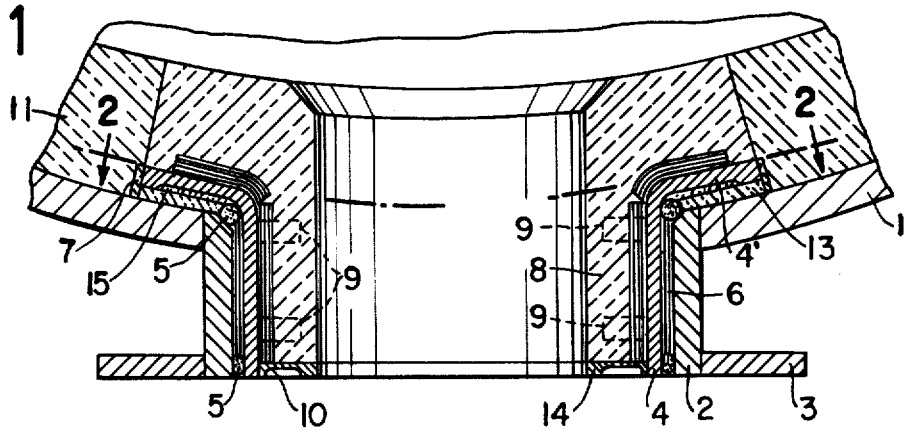
FIG. 1 is a cross-sectional view of an outlet of a rotary kiln constructed according to the present invention.

Referring to the FIGS., a cooler outlet from a rotary kiln is shown in FIG. 1. The kiln has an opening in its shell 1 which is provided with a support frame comprising a stub tube 2 and a flange 3 for bolting on of an associated cooler tube (not shown). A steel reinforcing ring 4 is provided internally of the stub tube 2. The end of the ring 4 is located within the kiln and has an integral annular rectangular collar 4' which extends generally parallel with the kiln shell 1 and extending radially beyond the joint between the stub tube 2 and the kiln shell 1. Heat insulating materials are provided between the steel ring 4 and the support frame and kiln shell 1. The heat insulating materials are in the form of ceramic felt 6, a ceramic body 13 and ceramic ropes 5.

In order to prevent any penetration of the material under the collar 4' of the reinforcing ring 4, a ceramic ring 7 is provided along the rim of the collar 4' and underlying the ceramic lining 11 of the kiln. The ring 4 and collar 4' are coated internally and on the side facing the kiln respectively with a wear-resistant ceramic material 8 braced to the ring 4 by means of anchoring elements 9. To protect the ring 4 against the heat conducted through the ceramic material 8—which is chosen for its mechanical strength rather than its heat insulation properties—a layer 10 of heat-resistant insulating material is inserted between the ceramic material 8, and the ring 4 and collar 4'.

In the exemplary embodiment shown in the drawings, the ceramic material 8 which constitutes both the lining for the ring 4 and for the collar 4' lies flush with the kiln lining 11. At its outer end the ceramic material 8 is limited by a collar 14 which is attached to the ring 4 or, alternatively, is cast integrally with the ring 4. To form the kiln outlet, the ceramic material 8 is cast on the steel ring 4 and collar 4' with the insulating layer 10 in such a manner that the ring 4 can thereafter be located in the stub tube 2, whereafter the joint between the ceramic material 8 and the kiln lining 11 is subsequently formed.

Figure 2:
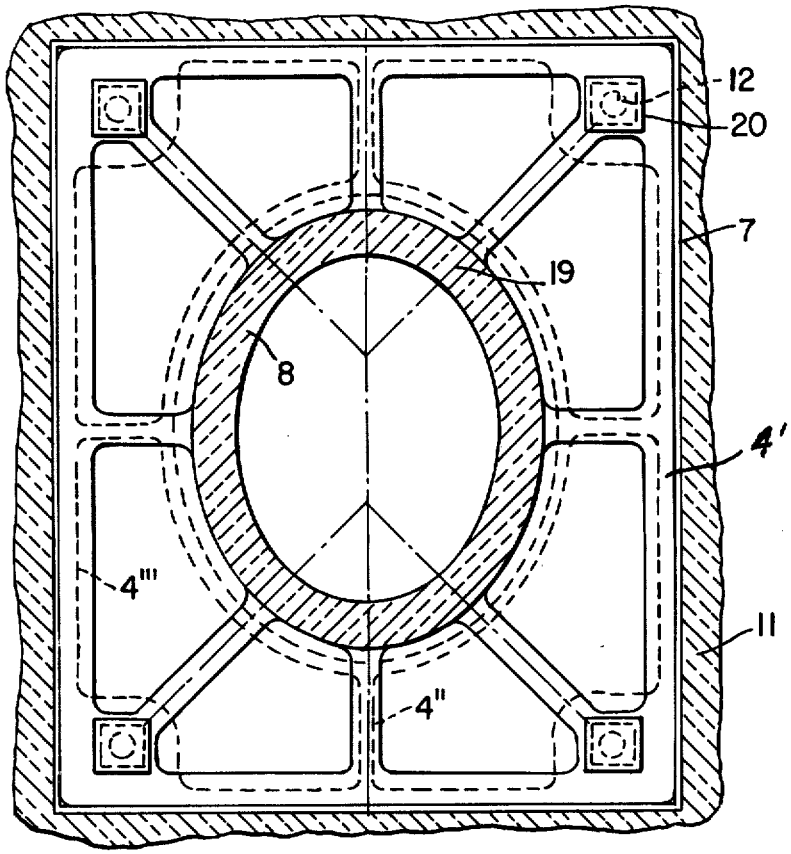
FIG. 2 is a view, partially in cross-section, taken along the line 2—2 of FIG. 1.
Figure 3:
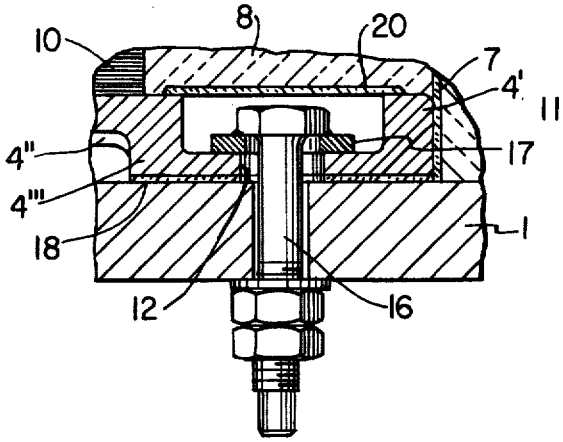
FIG. 3 is an enlarged cross-sectional view of a preferred embodiment of the method of attachment of the collar to the kiln shell.

Referring to FIGS. 2 and 3, the collar 4' is provided with bolt holes 12 so that the ring 4 can be firmly attached to the kiln shell 1 at a suitable distance from the joint between the kiln shell 1 and the stub tube 2. On its underside the collar 4' is provided with reinforcing ribs 4'' and a reinforcing outer rim 4'''. During the mounting of the steel ring 4 a plastic insulating material 15 is poured into a cavity formed on the underside of the collar situated within the rim. When the ring 4 and integral collar 4' are attached to the kiln shell 1, excess plastic material is pressed out from the underside of the collar. Then the ceramic ring 7 is positioned.

Referring to FIG. 3, the bolt holes 12 are situated in a section of the collar 4' which is recessed relative to the rest of the collar 4' in such a way that there is only a small gap between the collar 4' and the kiln shell 1 at these points. This gap is filled with a thin intermediate heat insulating sheet 18 when the collar 4' is secured to the kiln shell 1 by means of a bolt 16 and intermediate disc or washer 17. The head of the bolt 16 is located in the recess and is covered with a sheet 20 of ceramic material which in turn is covered by the ceramic lining material which is cast to form the transition between the ceramic material 8 and the kiln lining 11. The clearance between the bolt 16 and the bolt hole 12 is sufficiently large to allow for the heat expansion movements of the collar 4' parallel with the kiln shell 1. Longitudinal expansion of the steel ring 4 will cause the free end of the ring 4 to move, but will not affect the firm abutment of the ceramic material against the collar 4'.

Referring to FIG. 2, the ceramic lining 8 has radially extending expansion joints 19 which allow the ceramic material to undergo expansion movements without these movements causing uncontrolled crack formations. The insulating layer 10 between the steel ring 4 and the ceramic material 8 can be inserted in sections such that the ceramic material can rest directly against the collar 4' to provide a firm support for the ceramic material 8 to prevent falling clinker from breaking the ceramic material 8 on impact.

The ring 4 and collar 4' effectively protect and reinforce the joint between the kiln shell 1 and stub tube 2 from penetration of destructive hot material. Even if the ceramic lining 8 of the ring 4 is damaged, the ring 4 and the insulating material between the ring 4 and the kiln shell 1 and support tube 2 are capable of providing protection for a considerable time thus enabling the kiln to be stopped before serious damage occurs. Surveillance of the temperature of the steel frame can provide an early warning of developing defects.

I claim:

1. A rotary kiln which comprises a plurality of outlet openings for passing material from within the kiln to associated cooler tubes mounted in planetary fashion around the outlet end portion of the kiln, each kiln outlet opening having a tubular support member to which the inlet end portion of the associated cooler tube is attached, and a reinforcing ring positioned within said support members, insulation means positioned between the ring and said support member, said ring being lined internally with a wear-resisting ceramic material, an annular collar formed of the same material as said ring and carried by said ring at the end portion thereof closest to the kiln, said collar extending radially beyond the joint between said support member and the kiln shell, said collar being insulated from both the support member and the kiln shell, means positioned adjacent said collar for directly attaching said collar to the kiln shell and adapted so as to allow for the expansion of said ring, and coating means in the form of wear-resistant ceramic material on said collar.

2. The rotary kiln according to claim 1 wherein said reinforcing ring is of steel construction and said ceramic material with which said collar is coated is flush with the kiln lining and with the lining of said reinforcing ring and is formed integrally with the lining of said reinforcing ring.

3. The rotary kiln according to claim 1 wherein said annular collar is cast integrally with said reinforcing ring.

4. The rotary kiln according to claim 2 wherein said annular collar is cast integrally with said reinforcing ring.

5. The rotary kiln according to claim 1 wherein a layer of insulating material is provided between said steel reinforcing ring and its coat of ceramic material.

6. The rotary kiln according to claim 2 wherein a layer of insulating material is provided between said steel reinforcing ring and its coat of ceramic material.

7. The rotary kiln according to claim 3 wherein a layer of insulating material is provided between said steel reinforcing ring and its coat of ceramic material.

8. The rotary kiln according to claim 4 wherein a layer of insulating material is provided between said steel reinforcing ring and its coat of ceramic material.

9. The rotary kiln according to any of claims 1, 2, 3, 4, 5, 6, 7 and 8 wherein generally radially oriented expansion joints are provided in said ceramic material.

10. A rotary kiln having a plurality of outlets for passing material from within the kiln to associated cooler tubes mounted in use in planetary fashion around the outlet end of the kiln, each kiln outlet having a tubular support to which the inlet end of the associated cooler tube is attached and a steel reinforcing ring within the support, insulation being provided between the ring and the support and the ring being lined internally with a wear-resisting ceramic material, characterized in that the steel reinforcing ring carries, at its end located within the kiln, an annular collar formed of the same material as the ring, the collar extending radially beyond the joint between the support and the kiln shell, means for insulating said collar from both the support and the kiln shell, means positioned adjacent said collar for directly bolting said collar to the kiln shell and adapted so as to allow for the expansion of said ring, and wear-resisting ceramic material coating means on said collar.

* * * * *